US010798474B2

(12) United States Patent
Kurihara et al.

(10) Patent No.: US 10,798,474 B2
(45) Date of Patent: Oct. 6, 2020

(54) WATERPROOF SOUND-TRANSMISSIVE COVER, WATERPROOF SOUND-TRANSMISSIVE COVER MEMBER AND ACOUSTIC DEVICE

(71) Applicant: W. L. Gore & Associates, Co., Ltd., Tokyo (JP)

(72) Inventors: Yasuhiro Kurihara, Tokyo (JP); Ryan Kenaley, Newark, DE (US); Nobuyuki Osugi, Tokyo (JP); Takayuki Saeki, Tokyo (JP); Ryosuke Nakamura, Tokyo (JP); Takafumi Namba, Tokyo (JP)

(73) Assignee: W. L. Gore & Associates, Co., Ltd., Tokyo (JP)

( * ) Notice: Subject to any disclaimer, the term of this patent is extended or adjusted under 35 U.S.C. 154(b) by 0 days.

(21) Appl. No.: 16/319,929

(22) PCT Filed: Jul. 7, 2017

(86) PCT No.: PCT/JP2017/024970
§ 371 (c)(1),
(2) Date: Jan. 23, 2019

(87) PCT Pub. No.: WO2018/020987
PCT Pub. Date: Feb. 1, 2018

(65) Prior Publication Data

US 2019/0268679 A1 Aug. 29, 2019

Related U.S. Application Data

(63) Continuation of application No. PCT/JP2017/024970, filed on Jul. 7, 2017.

(30) Foreign Application Priority Data

Jul. 27, 2016 (JP) ..... 2016-147521

(51) Int. Cl.
*H04R 1/02* (2006.01)
*H04R 1/08* (2006.01)

(52) U.S. Cl.
CPC ..... *H04R 1/023* (2013.01); *H04R 1/086* (2013.01); *H04R 2499/11* (2013.01)

(58) Field of Classification Search
CPC .... H04R 1/023; H04R 1/086; H04R 2499/11; B32B 5/02; B32B 9/045; B32B 27/322;
(Continued)

(56) References Cited

U.S. PATENT DOCUMENTS 4,187,390 A 2/1980 Gore
5,814,405 A 9/1998 Branca et al.
(Continued)

FOREIGN PATENT DOCUMENTS

CN 105765992 A 7/2016
EP 3 209 027 A1 8/2017
(Continued)

OTHER PUBLICATIONS

International Search Report and Written Opinion from International Application No. PCT/JP2017/024970 dated Oct. 16, 2017.

*Primary Examiner* — Jason R Kurr
(74) *Attorney, Agent, or Firm* — Greenberg Traurig, LLP

(57) ABSTRACT

The waterproof sound-transmissive cover is characterized by providing a frequency response curve with a difference between a maximum sound pressure level and a minimum sound pressure level of 13.0 dB or less in the range of frequencies from 3 kHz to 8 kHz, and an insertion loss at 1 kHz of less than 14.0 dB, and said cover comprising: a porous film having (1) a water pressure resistance measured according to JIS L1092 water penetration test method B (high pressure method) of 20 kPa or more, and air permeability measured according to JIS L1096 method A (Frazier
(Continued)

type method) of 3.0 cc/cm$^2$·sec or more, and (2) a tensile strength measured according to ASTM standards D412 of 5.5N or more.

16 Claims, 4 Drawing Sheets

(58) Field of Classification Search
CPC .. B32B 2307/10; B01D 71/36; B01D 53/228; B01D 69/02; B01D 63/087; B01D 2325/20
See application file for complete search history.

(56) References Cited

U.S. PATENT DOCUMENTS

2011/0143114 A1* 6/2011 Horie ..... B32B 5/32 428/219
2013/0333978 A1* 12/2013 Abe ..... G10K 11/002 181/291
2014/0048351 A1* 2/2014 Banter ..... G10K 11/002 181/286
2014/0283691 A1* 9/2014 Furuuchi ..... B01D 71/36 96/12
2015/0050464 A1* 2/2015 Ishii ..... B01D 53/228 428/192
2015/0238909 A1* 8/2015 Mori ..... C08J 7/047 96/12
2015/0373439 A1* 12/2015 Mori ..... H04M 1/03 381/334
2016/0249119 A1* 8/2016 Mori ..... H04R 1/086
2016/0301998 A1* 10/2016 Abe ..... H04R 1/086
2016/0337737 A1* 11/2016 Kato ..... H04R 1/086
2016/0354997 A1* 12/2016 Huang ..... B32B 5/18
2017/0006365 A1* 1/2017 Mori ..... G10K 9/22
2017/0245036 A1* 8/2017 Kuki ..... C08J 7/12

FOREIGN PATENT DOCUMENTS

| | | | |
|---|---|---|---|
| JP | 2815618 | | 7/1989 |
| JP | 2003-041182 | A | 2/2003 |
| JP | 2010-165787 | A | 7/2010 |
| JP | 2014-207590 | A | 10/2014 |
| JP | 2015-063121 | A | 4/2015 |
| JP | 2015-119474 | A | 6/2015 |
| JP | 2015-536075 | A | 12/2015 |
| JP | 2016-082595 | A | 5/2016 |
| WO | WO 199706206 | A1 | 2/1997 |
| WO | 97/45829 | A1 | 12/1997 |
| WO | WO 2001003468 | A2 | 1/2001 |
| WO | WO-2014/047406 | A1 | 3/2014 |
| WO | WO 2015029451 | A1 | 3/2015 |
| WO | WO 2015072149 | | 5/2015 |

* cited by examiner

[Fig. 1]
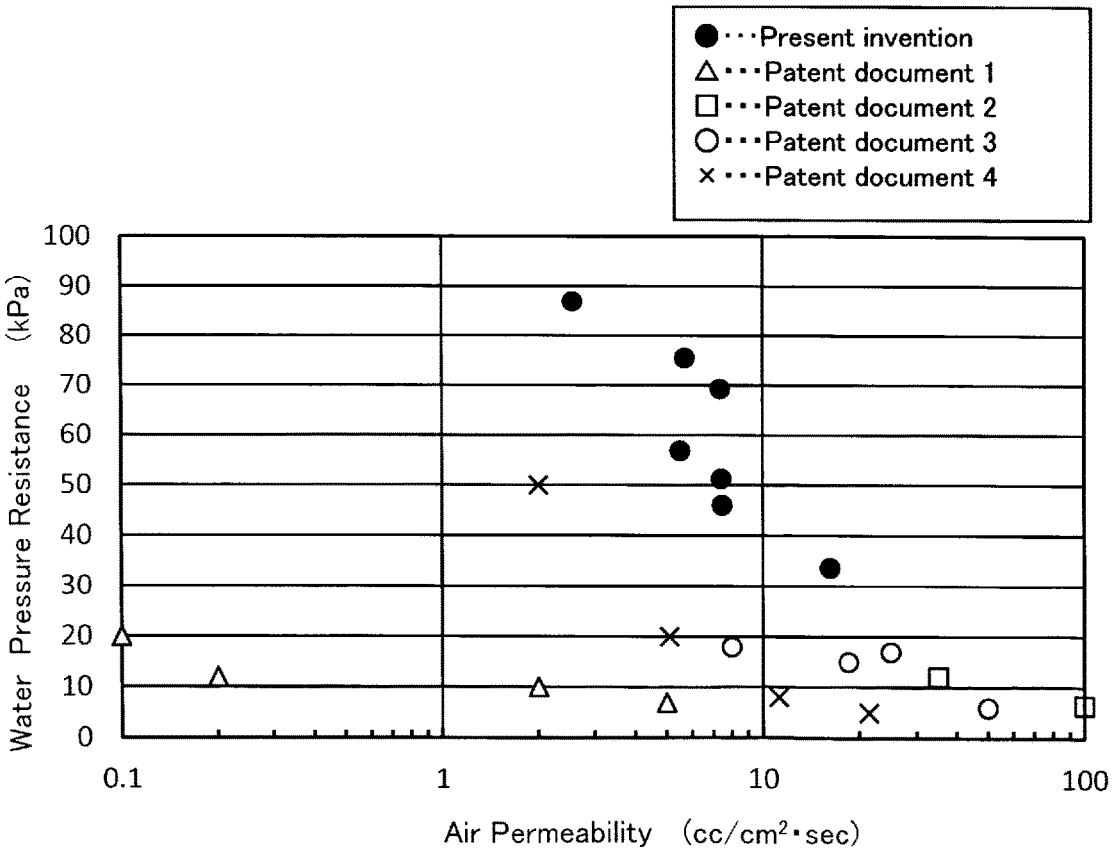
[Fig. 2]
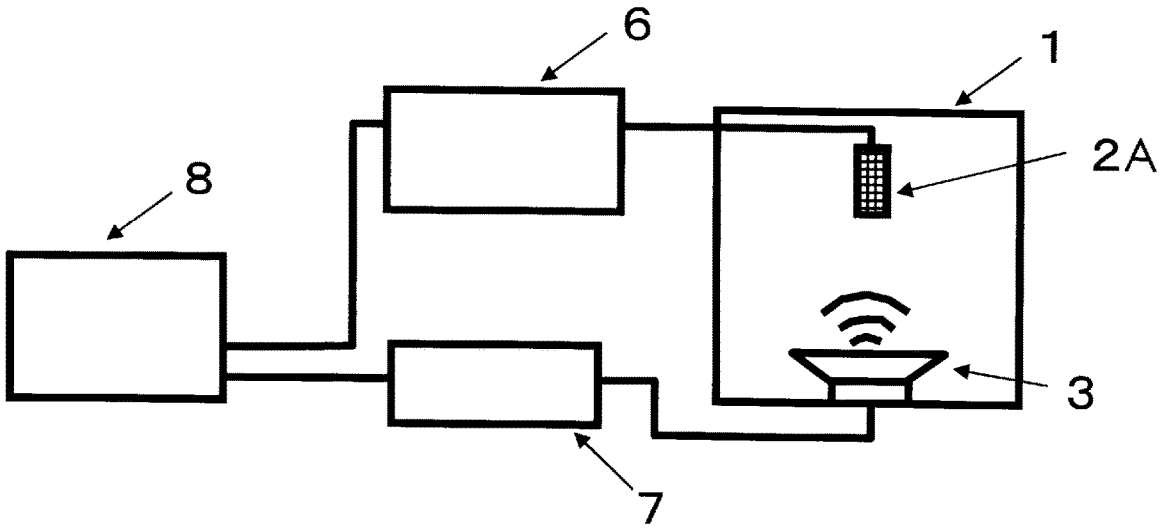

[Fig. 3]
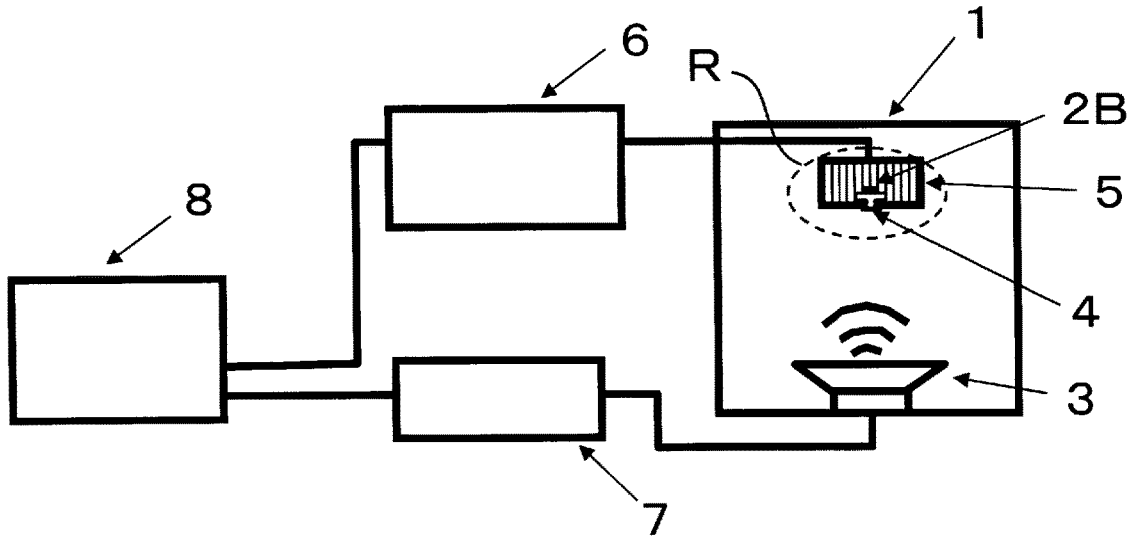
[Fig. 4]
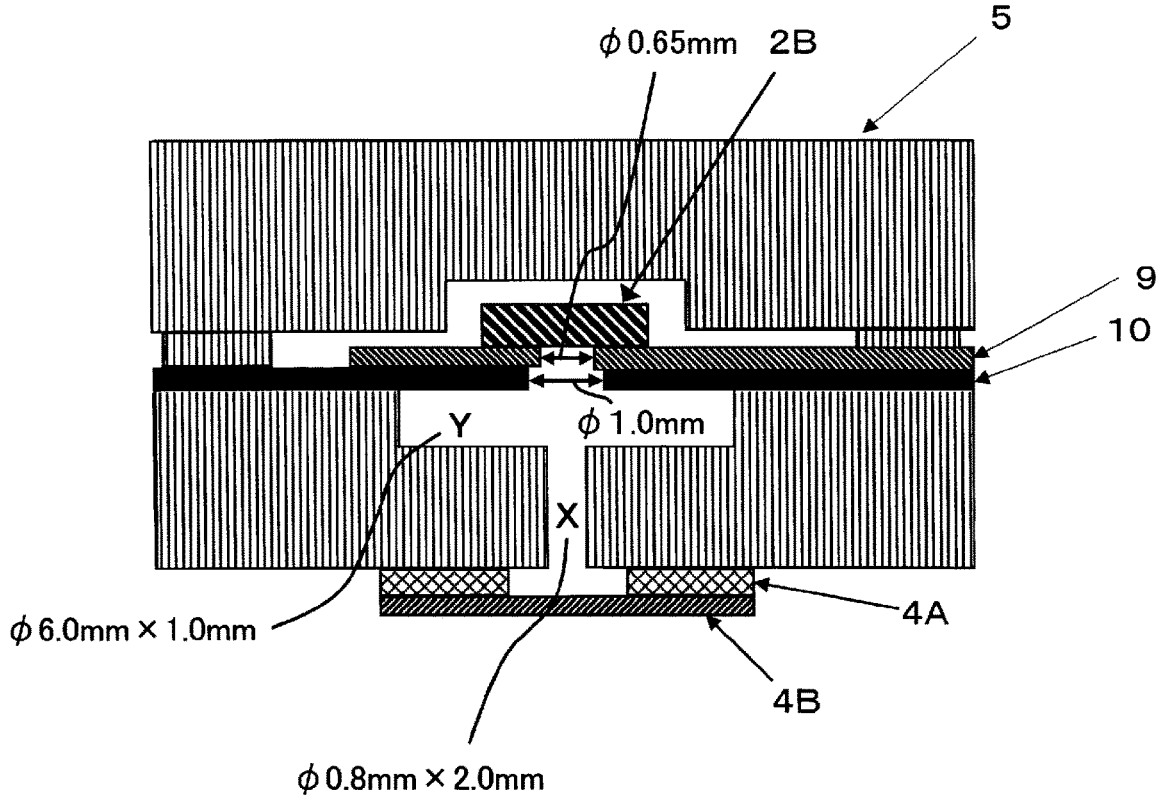

[Fig. 5]
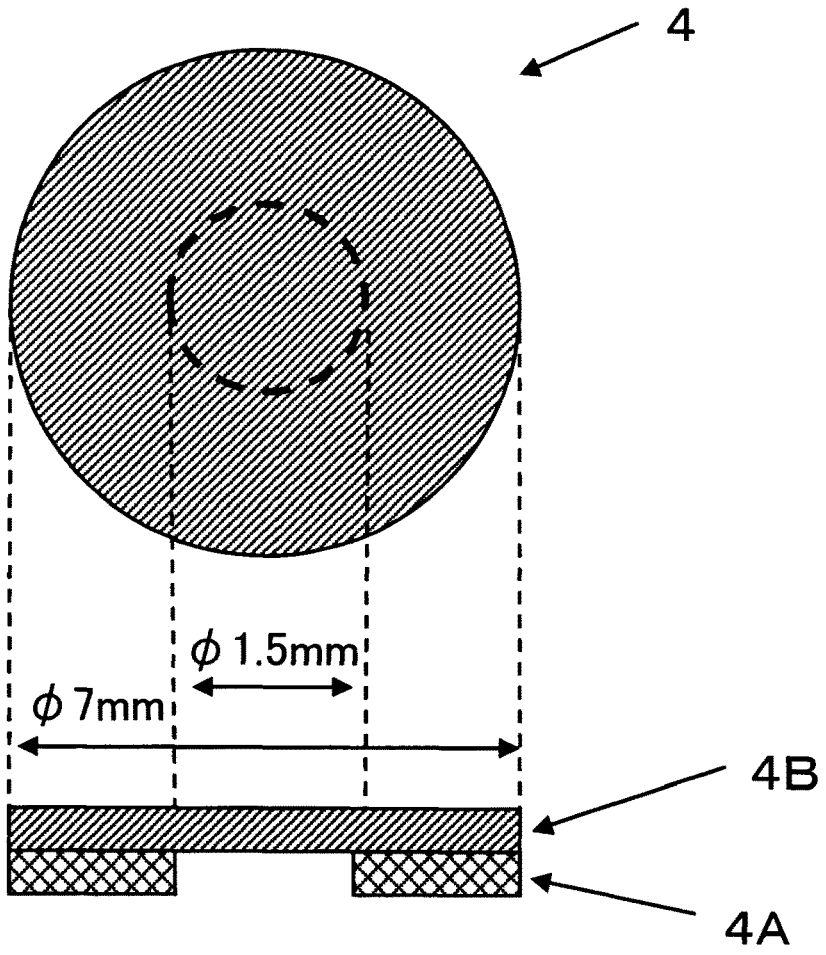
[Fig. 6]
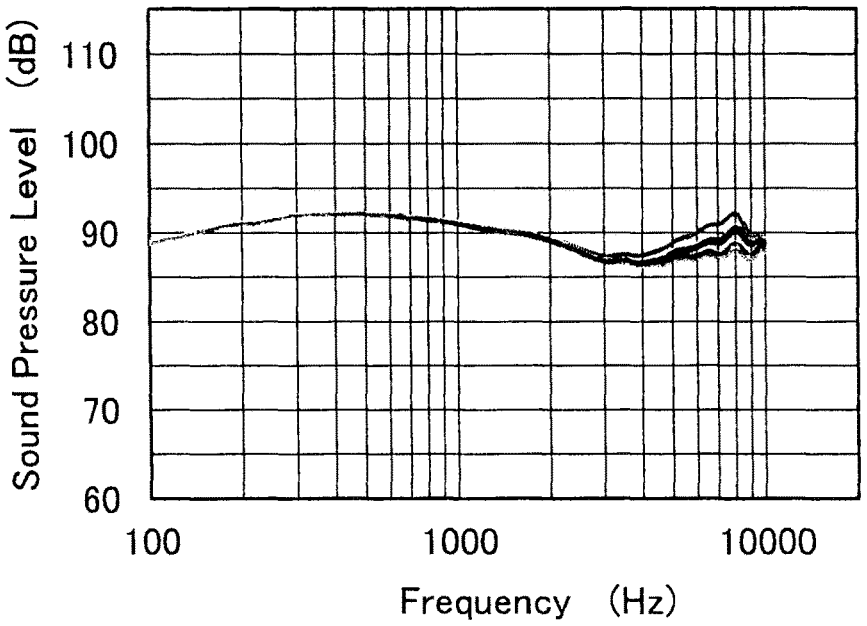

[Fig. 7]
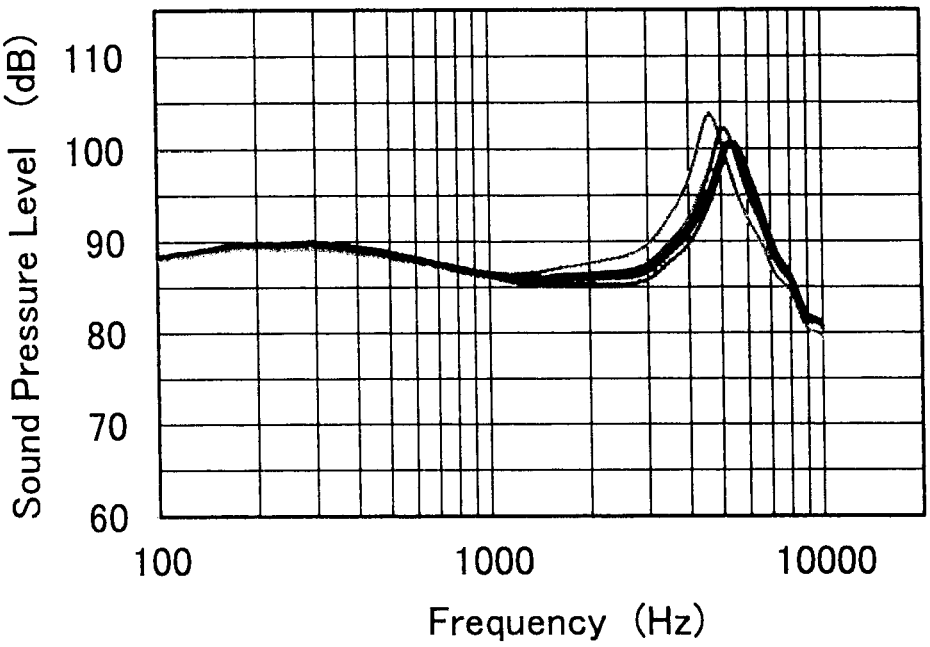
[Fig. 8]
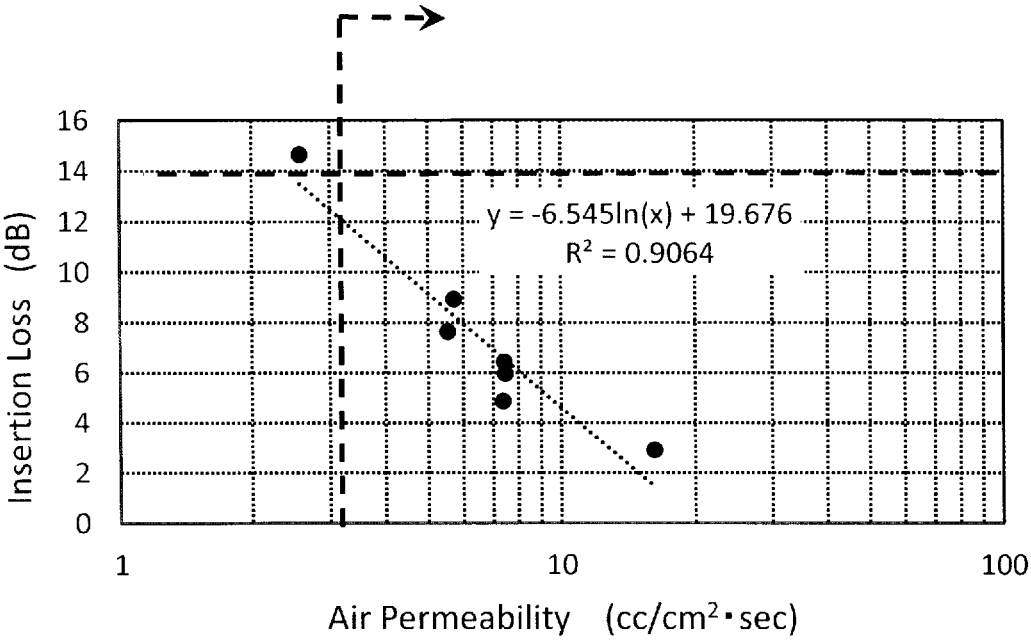

WATERPROOF SOUND-TRANSMISSIVE COVER, WATERPROOF SOUND-TRANSMISSIVE COVER MEMBER AND ACOUSTIC DEVICE

RELATED APPLICATIONS

The present application is a national phase filing under 35 USC 371 of International Application No. PCT/JP2017/024970 filed on Jul. 7, 2017, which claims priority to Japanese Patent Application No. 2016-147521 filed Jul. 27, 2016, the entire contents and disclosures of which are hereby incorporated by reference.

TECHNICAL FIELD

The present invention relates to a waterproof sound-transmissive cover, a waterproof sound-transmissive cover member and an acoustic device. Particularly, the present invention relates to a waterproof sound-transmissive cover which exhibits high water resistance and also exhibits an excellent acoustic property, and a waterproof sound-transmissive cover member and an acoustic device which use the waterproof sound-transmissive cover.

BACKGROUND ART

An electric product such as a portable phone, a digital camera and a portable music reproducing device includes an acoustic unit including a speaker or a microphone. In the acoustic unit, an acoustoelectric converter such as a speaker that sends an acoustic wave and a microphone that receives an acoustic wave is held in a housing, and has an opening through which an acoustic wave passes, between acoustic space in this housing and an outside of the housing. When water or other liquid flows into or foreign matter such as dust enters the housing through the opening of the housing during use of the electric product, this may lead to malfunction of the acoustoelectric converter or cause generation of noise. Accordingly, the opening is generally provided with a cover made of porous material.

When the pore size of the porous material is made small in order to sufficiently prevent the intrusion of water or the like, this causes decrease in the acoustic property such as increase in attenuation of an acoustic wave, though a protective property such as waterproofness/dustproofness of the acoustic unit is enhanced. In contrast, when the pore size of the porous material is made large in order to enhance the acoustic property, the protective property of the acoustic unit decreases. From these reasons, a cover provided at the opening is demanded to have both an excellent protective property and an excellent acoustic property.

For example, as a waterproof sound-transmissive material having both sound transmissivity and water resistance, Patent Document 1 describes a waterproof sound-transmissive material which is a sheet material having a number of fine through-holes formed dispersedly and which has air permeability measured by a Frazier type tester of 0.1 cc/cm$^2$·sec or more and water pressure resistance set at 30 cmaq or more.

As a PTFE porous film having excellent dustproofness and excellent air permeability and also having excellent sound transmissivity and excellent water resistance, Patent Document 2 describes a polytetrafluoroethylene porous film in which a sound pressure variation of a sound having a frequency which is not less than 300 and not more than 3000 Hz is 1 dB or less, a sound pressure variation of a sound having a frequency which is more than 3000 and 10000 Hz or less is 5 dB or less, and water pressure resistance measured according to a JIS L1092A method (hydrostatic pressure method) is 30 cm or more.

Moreover, as a waterproof sound-transmissive film having excellent waterproofness and an excellent sound-transmissive property, Patent Document 3 suggests a waterproof air-permeable film including a non-porous resin film having a plurality of through holes penetrating the film in a thickness direction, and a liquid-repellent layer which is formed on a principal plane of the resin film and which has an opening at a position corresponding to the plurality of through holes. In the waterproof air-permeable film, the through holes extend linearly and each have a diameter of 15 μm or less, hole density of the through holes in the resin film is not less than $1\times10^3$/cm$^2$ and not more than $1\times10^9$/cm$^2$, the resin film has the through holes which extend in a direction inclined relative to a direction perpendicular to the principal plane of the film, and the through holes extending in different inclined directions coexist in the resin film.

As a waterproof sound-transmissive film which can ensure waterproofness of a weather-roof level or more and which can suppress occurrence of sound distortion, Patent Document 4 suggests a waterproof sound-transmissive film having a sound-transmissive area made of a polytetrafluoroethylene porous film. In the waterproof sound-transmissive film, air permeability in a thickness direction of the porous film measured according to air permeability measuring method A (Frazier type method) specified in JIS L1096 is 2 cm$^3$/cm$^2$/s or more, and water pressure resistance of the porous film measured according to waterproofness test method B (high pressure method) specified in JIS L1092 is 3 kPa or more.

However, in these years, there is a demand of a waterproof sound-transmissive film which exhibits excellent waterproofness and also an acoustic property higher than a product of the related art.

CITATION LIST

Patent Literature

PTL 1: JP-A-03-041182
PTL 2: JP-A-10-165787
PTL 3: JP-A-2015-063121
PTL 4: JP-A-2015-119474

SUMMARY OF INVENTION

Technical Problem

The present invention has been made by focusing on such circumstances, and an object of the present invention is to provide a waterproof sound-transmissive cover having excellent waterproofness and also an acoustic property higher than a product of the related art, particularly a sufficiently suppressed sound pressure level difference owing to frequencies over a wide frequency range, and a waterproof sound-transmissive cover member and an acoustic device which use this waterproof sound-transmissive cover.

Solution to Problem

The waterproof sound-transmissive cover for an acoustic device, which can achieve the above object, is characterized by providing a frequency response curve with a difference between a maximum sound pressure level and a minimum sound pressure level, hereinafter referred to as "sound pressure level difference", of 13.0 dB or less in the range of frequencies from 3 kHz to 8 kHz, and an insertion loss at 1 kHz of less than 14.0 dB, and said cover comprising:

a porous film having (1) a water pressure resistance measured according to JIS L1092 water penetration test method B (high pressure method) of 20 kPa or more, and air permeability measured according to JIS L1096 method A (Frazier type method) of 3.0 cc/cm$^2$·sec or more, and (2) a tensile strength measured according to ASTM standards D412 of 5.5N or more.

The porous film preferably comprises a polytetrafluoroethylene film, having a plurality of nodes and a plurality of fibrils formed between the nodes;

wherein each of the nodes has an aspect ratio represented by length/diameter of the node of 25 or more.

The waterproof sound-transmissive cover preferably has a thickness in the range of 10 to 300 micrometers.

The water pressure resistance of the porous film is preferably 55 kPa or less.

The frequency response curve preferably further has a property that a sound pressure level at a frequency of 8 kHz is smaller than a sound pressure level at a frequency of 1 kHz.

The frequency response curve also preferably has a property that a sound pressure difference in the range of frequencies from 3 kHz to 5 kHz is 4.0 dB or less, and a sound pressure difference in the range of frequencies from 5 kHz to 8 kHz is 9.0 dB or less.

The porous film is preferably a single layer of the porous polytetrafluoroethylene film.

The present invention also includes a waterproof sound-transmissive cover member characterized by comprising:

said waterproof sound-transmissive cover; and a support layer which is formed on at least one side of the waterproof sound-transmissive cover.

The present invention also includes an acoustic device comprising said waterproof sound-transmissive cover member. The acoustic device is characterized by sending and/or receiving an acoustic wave, and comprising:

a housing having an opening through which an acoustic wave passes;

an acoustoelectric converter which is disposed inside of the housing; and the waterproof sound-transmissive cover member, which covers the opening of the housing.

Advantageous Effects of Invention

Since a waterproof sound-transmissive cover of the present invention used for an acoustic device includes a porous film which exhibits high water pressure resistance and high air permeability and also exhibits certain strength or more, the waterproof sound-transmissive cover exhibits excellent waterproofness and also an acoustic property more excellent than the related art, particularly a property of a sufficiently suppressed sound pressure level difference owing to frequencies over a wide frequency range. The present invention can provide the waterproof sound-transmissive cover, a waterproof sound-transmissive cover member using the waterproof sound-transmissive cover, and an acoustic device having an excellent acoustic property.

BRIEF DESCRIPTION OF DRAWINGS

FIG. 1 is a graph showing a relation between water pressure resistance and air permeability in an example.

FIG. 2 is a schematic view of an acoustic evaluation device used for calibration of a speaker in an example.

FIG. 3 is a schematic view of an acoustic evaluation device used for actual measurement in an example.

FIG. 4 is an enlarged sectional view of a region R in FIG. 3.

FIG. 5 is a top view seen from the porous film side of a part sample used in an example, and a sectional view along a diameter position of a part sample used in an example.

FIG. 6 is a frequency response curve of No. 4 in Table 1.

FIG. 7 is a frequency response curve of No. 5 in Table 1.

FIG. 8 is a graph showing a relation between air permeability and an insertion loss at a frequency of 1 kHz in an example.

DESCRIPTION OF EMBODIMENTS

The present inventors have carried out earnest researches in order to obtain a waterproof sound-transmissive cover having excellent waterproofness and an acoustic property higher than a product of the related art, particularly a certain sound pressure level or more and a sufficiently suppressed sound pressure level difference owing to frequencies over a wide frequency range of, for example, 100 to 10000 Hz.

As a result, the present inventors have found that a waterproof sound-transmissive cover of the present invention which realizes the above-described properties has a porous film which satisfies the following (1) and (2). The waterproof sound-transmissive cover has a frequency response curve in which a difference between a maximum sound pressure level and a minimum sound pressure level (sound pressure level difference) in the range of frequencies from 3 kHz to 8 kHz satisfies 13.0 dB or less, and the waterproof sound-transmissive cover further has an insertion loss at a frequency of 1 kHz that satisfies less than 14.0 dB. The following description will first explain the following properties (1) and (2) of a porous film which constitutes the waterproof sound-transmissive cover of the present invention. It is to be noted that a unit "dB" of a sound pressure level is based on 20 μPa in the present invention.

(1) Water pressure resistance measured according to JIS L1092 water penetration test method B (high pressure method) is 20 kPa or more, and air permeability measured according to JIS L1096 method A (Frazier type method) is 3.0 cc/cm$^2$·sec or more.

(2) Tensile strength measured according to ASTM standards D412 is 5.5 N or more.

(Water Pressure Resistance and Air Permeability of Porous Film)

A porous film which constitutes the waterproof sound-transmissive cover of the present invention has water pressure resistance measured according to the above-described method of 20 kPa or more, and also air permeability measured according to the above-described method of 3.0 cc/cm$^2$·sec or more, as described in (1). As described in the following examples an insertion loss at a frequency of 1 kHz can be suppressed sufficiently by particularly enhancing the air permeability. The water pressure resistance is preferably 25 kPa or more, and more preferably 30 kPa or more. Moreover, the air permeability is preferably 5.0 cc/cm$^2$·sec or more, and more preferably 7.0 cc/cm$^2$·sec or more.

The water pressure resistance and the air permeability are in a relation of inverse proportion to each other as shown by "●" (closed circles) in FIG. 1 described below. For example, it is clear from FIG. 1 described below that it is preferable to suppress the water pressure resistance to be 90 kPa or less in order to achieve the above-described air permeability of 3.0 cc/cm$^2$·sec or more. The water pressure resistance is more preferably 55 kPa or less. Moreover, from FIG. 1 described below, the air permeability is preferably 25 cc/cm$^2$·sec or less in order to achieve the above-described water pressure resistance of 20 kPa or more. The air permeability is more preferably 17 cc/cm$^2$·sec or less, and further preferably 10 cc/cm$^2$·sec or less.

(Tensile Strength of Porous Film)

The porous film further satisfies tensile strength measured according to ASTM standards D412 of 5.5 N or more. The tensile strength is preferably 6.0 N or more, more preferably 7.0 N or more, and further preferably 10.0 N or more. On the other hand, it is considered that when the tensile strength is too high, an insertion loss in a high frequency range increases. For this reason, the tensile strength is preferably 30 N or less, and more preferably 20 N or less.

Detailed measurement conditions of water pressure resistance, air permeability and tensile strength of the porous film are as described in the following examples.

(Material, Form and Manufacturing Method Applicable to Porous Film of Present Invention)

Material of the porous film of the present invention is not limited as long as the porous film satisfies the above-described properties. Examples of the material of the porous film include a porous film formed of the following resin. Examples of the resin includes: polyolefin such as polyamide, polyester, polyethylene and polypropylene; and a fluorocarbon resin having excellent waterproofness such as polytetrafluoroethylene (PTFE), polyvinylidene fluoride (PVDF), tetrafluoroethylene-hexafluoro-propylene copolymer (FEP), and tetrafluoroethylene-(perfluoroalkyl) vinyl ether copolymer (PFA).

Preferable examples of the material of the porous film include a porous polytetrafluoroethylene film and a porous high molecular weight polyethylene film. A porous polytetrafluoroethylene film is more preferable. A porous polytetrafluoroethylene film which has a plurality of nodes and a plurality of fibrils formed between the nodes and which has an aspect ratio represented by length/diameter of each node of 25 or more is further preferable.

Examples of a form of the porous film include: a single layer formed of one type of a porous resin film; a lamination layer (laminate) formed of two or more types of porous resin films; and a lamination layer of these and an elastic and air-permeable reinforcement layer such as mesh and net such as nonwoven fabric, woven fabric and knitted fabric. In a case of the lamination layer, the water pressure resistance, the air permeability and the tensile strength are measured in a state of the lamination layer. Preferable examples of the form of the porous film include a form including the porous polytetrafluoroethylene film, that is, a single layer of the porous polytetrafluoroethylene film, and a lamination layer including the porous polytetrafluoroethylene film. Examples of the lamination layer include a lamination layer of a plurality of porous polytetrafluoroethylene films, and a lamination layer of a porous polytetrafluoroethylene film and the reinforcement layer (for example, nonwoven fabric such as nonwoven polyester fabric). A more preferable form of the porous film is a single layer of the porous polytetrafluoroethylene film.

The porous film may be subjected to liquid repelling treatment, in order to sufficiently suppress leakage of liquid having low surface tension. Examples of the liquid repelling treatment include coating a surface of a porous film with liquid repellant, and also include mixing hydrophobic nanoparticles into a porous film. The "liquid repelling" in this case refers to repelling liquid, and means water repelling and/or oil repelling. The porous film having liquid repellency can suppress infiltration or retention in pores of a porous film of various contaminants such as body fat, machine oil and a water drop which decrease functions such as an acoustic property. As material and a method used for the liquid repelling treatment, for example, material and methods disclosed in U.S. Pat. Nos. 5,116,650, 5,286,279, 5,342,434, 5,376,441 and the like can be used. Particularly, an example of the liquid repelling treatment includes coating of a fluorine-containing polymer. Examples of the fluorine-containing polymer include a dioxole/TFE copolymer taught in specifications of U.S. Pat. Nos. 5,385,694 and 5,460,872, perfluoroalkyl acrylate and perfluoroalkyl methacrylate taught in U.S. Pat. No. 5,462,586, fluoroolefin, and fluorosilicone. Among them, it is preferable to treat with a dioxole/TFE copolymer and a perfluoroalkyl acrylate polymer.

The porous film may be subjected to coloring treatment, for example applying or incorporating a colorant including a pigment such as carbon black, or a dye used for coloring in order to improve appearance.

The porous film can be obtained by a known method such as: a phase separation method; an extraction method using a polymer, organic matter or inorganic matter; a chemical treatment method by acid/alkaline treatment or the like; a stretching method; an irradiation etching; a fusion method; a foaming method with mechanical, physical or chemical means; a surface treatment method such as plasma treatment or graft treatment; or a composite method of a combination of a plurality of these techniques. In order to obtain a porous polytetrafluoroethylene film having a plurality of nodes and a plurality of fibrils formed between the nodes, for example, material or processes described in specifications of U.S. Pat. Nos. 3,953,566, 4,187,390, 4,110,392 and 5,814,405 are used, and, for example, a stretch ratio or heating temperature is adjusted. Among these, expanded polytetrafluoroethylene (ePTFE) which has nodes and a plurality of fibrils and which has an aspect ratio represented by length/diameter of each node of 25 or more can be obtained with reference of a method described in U.S. Pat. No. 5,814,405.

An example of a manufacturing method in a case of obtaining the porous polytetrafluoroethylene film is as follows. The porous polytetrafluoroethylene film can be obtained by a step of mixing and molding fine powder of PTFE and a molding auxiliary, removing the molding auxiliary, subsequently stretching at high temperature and at high speed, and further firing as necessary. The stretching may be uniaxial stretching or may be biaxial stretching. Moreover, as described in, for example, U.S. Pat. No. 5,814,405, a tape obtained by using a PTFE resin powder and extrusion/rolling or the like is stretched and expanded in a longitudinal direction at a temperature lower than a crystal melting point (343° C.) of the PTFE resin, to first obtain microporous stretched expanded PTFE (ePTFE). Then the microporous stretched expanded PTFE is heated to a temperature over the crystal melting point of the PTFE, for example, 343 to 375° C., and amorphous fixing is achieved. Further, the porous polytetrafluoroethylene film can be obtained by heating to a temperature over the highest crystal melting point of the existing PTFE, and then lengthening in, for example, a direction perpendicular to the stretching direction.

In order to obtain a porous film which satisfies the water pressure resistance, air permeability and tensile strength defined in the present invention, for example the stretch ratio before and after amorphous fixing are controlled in the above-described manufacturing method.

(Film Thickness of Waterproof Sound-Transmissive Cover)

A film thickness of the waterproof sound-transmissive cover of the present invention is preferably within the range of not less than 10 μm and not more than 300 μm. The film thickness is more preferably 15 μm or more, further preferably 18 μm or more, and further more preferably 20 μm or more, and is more preferably 250 μm or less, further preferably 220 μm or less, and further more preferably 200 μm or less. The film thickness of the waterproof sound-transmissive cover refers to a film thickness of a single layer in a case of the single layer, and refers to a total film thickness in a case of a lamination layer. In a case where the waterproof sound-transmissive cover is formed of only a porous film, a film thickness of this waterproof sound-transmissive cover means a film thickness of the porous film. In a case where the porous sound-transmissive cover is formed of a single layer of a porous film, the film thickness is preferably 50 μm or less, and more preferably 40 μm or less.

A shape of the waterproof sound-transmissive cover of the present invention is not particularly limited. The waterproof sound-transmissive cover may have any shape corresponding to an area (effective area) of the waterproof sound-transmissive cover, through which an acoustic wave passes. Examples of the shape include a circle, an ellipse, a rectangle and a polygon.

(Acoustic Property of Waterproof Sound-Transmissive Cover)

The waterproof sound-transmissive cover of the present invention includes the above-described porous film, and exhibits the following properties when the acoustic property is evaluated by using a device described in the following examples and under conditions described in the following examples. That is, in a frequency response curve having a horizontal axis and a vertical axis that represent respectively a frequency and sound pressure level obtained in the following examples, a difference between a maximum sound pressure level and a minimum sound pressure level (sound pressure level difference) in the range of frequencies from 3 kHz to 8 kHz represents a flat curve of 13.0 dB or less. The sound pressure level difference is preferably 10 dB or less, more preferably 5 dB or less, and further preferably 3 dB or less.

When a cover of the related art is used, a peak appears around frequencies from 3 kHz to 8 kHz (see FIG. 7 described below). When a peak appears, a sound pressure level difference owing to frequencies becomes large, and this leads to decrease in sound quality. Moreover, this peak is likely to vary as shown in FIG. 7 described below. On the other hand, the waterproof sound-transmissive cover of the present invention is expected to have improved sound quality, because a difference between a maximum sound pressure level and a minimum sound pressure level in the range of frequencies from 3 kHz to 8 kHz is sufficiently suppressed as described above.

Further, the waterproof sound-transmissive cover of the present invention has the frequency response curve in which an insertion loss at a frequency of 1 kHz is less than 14.0 dB, and a small sound loss. The insertion loss is more preferably 10 dB or less, further preferably 8.0 dB or less, further more preferably 6.5 dB or less, and most preferably 5.0 dB or less.

The insertion loss refers to a decrease amount of a sound pressure level (dB) from a basis of a sound pressure level (94 dB) at a frequency of 1 kHz which is measured in a state where only part sample 4 in FIG. 3 is not attached as described in the following examples.

Moreover, the waterproof sound-transmissive cover of the present invention preferably has the frequency response curve in which a sound pressure level difference in the range of frequencies from 3 kHz to 5 kHz (3 k-5 kHz sound pressure level difference) is 4.0 dB or less, and in which a sound pressure level difference in the range of frequencies from 5 kHz to 8 kHz (5 k-8 kHz sound pressure level difference) is 9.0 dB or less. That is, preferably, a sound pressure level difference owing to frequencies is suppressed even in each narrowband in the frequency band from 3 kHz to 8 kHz, and a flatter frequency response curve is exhibited. The 3 k-5 kHz sound pressure level difference is more preferably 3.0 dB or less, further preferably 2.0 dB or less, and further more preferably 1.0 dB or less. The 5 k-8 kHz sound pressure level difference is more preferably 6.0 dB or less, further preferably 4.0 dB or less, and further more preferably 3.5 dB or less.

Further, the waterproof sound-transmissive cover of the present invention preferably has the frequency response curve in which a sound pressure level at a frequency of 8 kHz is smaller than a sound pressure level at a frequency of 1 kHz, and preferably has a suppressed sound pressure level change.

(Waterproof Sound-Transmissive Cover Member)

The present invention includes a waterproof sound-transmissive cover member including: the above-described waterproof sound-transmissive cover; and a support layer formed on at least one side of the waterproof sound-transmissive cover. An adhesion support systems with various structures described in JP-A-2009-303279 can be employed as the support layer, as long as the systems do not impair the above-described acoustic property. Preferably, a form having a support layer in a periphery of the waterproof sound-transmissive cover is employed. A thickness of the support layer can be 1 to 500 μm, for example.

Examples of material which constitutes the support layer include a resin and metal. Examples of the resin include a liquid or solid thermoplastic type, thermosetting type or reactive curing type resin selected from the group including acryl, polyamide, polyacrylamide, polyester, polyolefin, polyurethane and polysilicon. Alternatively, the material which constitutes the support layer may be metal such as stainless steel and aluminum, or composite material of the metal and the resin. Examples of a method for bonding the support layer to the waterproof sound-transmissive cover include heating adhesion, ultrasonic bonding, adhesion using an adhesive, and adhesion using a double sided tape. In a case of directly applying the support layer to the waterproof sound-transmissive cover, examples thereof include screen printing, gravure printing, spray coating and powder coating. A double sided adhesive tape can also be used as the support layer. Various types of tapes such as a nonwoven fabric substrate double sided adhesive tape having polyethylene nonwoven fabric, polypropylene nonwoven fabric, nylon nonwoven fabric or the like as a core member, a PET substrate double sided adhesive tape, a polyimide substrate double sided adhesive tape, a nylon substrate double sided adhesive tape, a foam (for example, urethane foam, silicone foam, acryl foam, polyethylene foam) substrate double sided adhesive tape and a substrateless double sided adhesive tape can be used as the double sided adhesive tape.

Moreover, a distance from an acoustoelectric converter or the like can be adjusted by providing an acoustic gasket as described in JP-A-2009-303279. Commercially available material known to those skilled in the art can be used as material of the acoustic gasket. For example, soft elastomer material or foam elastomer, for example, silicone rubber or silicone rubber foam can be used.

(Acoustic Device)

The present invention also includes an acoustic device using the waterproof sound-transmissive cover member. The acoustic device sends and/or receives an acoustic wave, and includes a housing having an opening through which an acoustic wave passes, an acoustoelectric converter which is disposed inside of the housing, and the above-described waterproof sound-transmissive cover member which covers the opening of the housing.

Examples of the acoustic devices include: electric products equipped with an acoustoelectric converter such as a speaker, a microphone and a receiver and having a voice function, such as the above-described portable phone including a smartphone, a compact radio, a portable music player, a portable music reproducing device such as a portable game machine, a transceiver, a headphone, an earphone, an outdoor microphone, a video camera, a digital camera, a tablet PC and a note PC; and an acoustic unit having the acoustoelectric converter such as a speaker, a microphone and a receiver, the housing and the acoustic cover, in these electric products.

As described above, the acoustic device has: the housing having the opening through which an acoustic wave passes between an outside of the housing and acoustic space formed in the housing; and the acoustoelectric converter which is disposed inside of the housing, such as a speaker or a buzzer that sends an acoustic wave or a microphone that receives an acoustic wave, and the opening is covered with the waterproof sound-transmissive cover member including the waterproof sound-transmissive cover. A configuration other than the above-described configuration of the acoustic device is not particularly limited, and a configuration normally used in each of the above-described acoustic devices can be employed. That is, specifications generally used in each of the above-described acoustic devices may be applied to a size/shape/material of the housing, a shape/size of the opening provided at the housing, and a type of the acoustoelectric device.

This application claims priority to Japanese Patent Application No. 2016-147521 filed on Jul. 27, 2016, the entire contents of which are incorporated by reference herein.

EXAMPLES

Although the following description will explain the present invention more specifically using examples, the present invention is not limited by the following examples, and modifications can be added and carried out in conformity with the gist described above/below, and all the modification are included in the technical scope of the present invention. That is, although evaluation in the following examples are performed by using a single layer of a porous film as a waterproof sound-transmissive cover, the present invention is not limited thereto, and various aspects described above can be employed.

Various single layers of porous polytetrafluoroethylene films shown in Table 1 were prepared as porous films.

Nos. 1 to 4 of the various single layers of the porous polytetrafluoroethylene films shown in Table 1 are porous stretched expanded polytetrafluoroethylene (porous ePTFE) films that were prepared according to teaching contents of U.S. Pat. No. 5,814,405. Moreover, Nos. 5 to 9 are porous stretched expanded polytetrafluoroethylene (porous ePTFE) films that were prepared according to teaching contents of U.S. Pat. Nos. 3,953,566, 4,187,390 and 4,110,392. Porous ePTFE films having various properties were obtained by adjusting a stretch ratio or heating temperature in the teaching contents.

A film thickness and property of each obtained porous ePTFE film were evaluated as follows.

(1) Film Thickness

The film thickness of each obtained porous ePTFE film was measured by using a dial gauge having a scale of 0.001 mm and a gauge head diameter of 10 mm. Results thereof are shown in Table 1.

(2) Water Pressure Resistance (iWEP)

Water pressure resistance was measured according to JIS L1092 (2009) water penetration test method B (high pressure method). Pressure rise in water penetration test method B was 0.98 kPa/sec. Moreover, in order to suppress deformation of the film, stainless steel mesh (mesh size of 120) was installed on a side opposite to a pressurizing side of the film and the measurement was performed. Measurement results are shown in Table 1.

(3) Air Permeability

Air permeability was measured according to JIS L1096 (2010) method A (Frazier type method). Measurement results are shown in Table 1.

Then, a case where the air permeability measured in (3) is 3.0 $cc/cm^2 \cdot sec$ or more and the water pressure resistance measured in (2) is 20 kPa or more was determined as success. A relation between the air permeability and the water pressure resistance of Nos. 1 to 7 in Table 1 is shown in FIG. 1. FIG. 1 also shows data described in Patent Documents 1 to 4.

(4) Tensile Strength

A tensile test was performed according to ASTM standards D412 and tensile strength was determined. In the tensile test, specimens of F type were used, and a test rate was 77.2 mm/min. This tensile test was performed in each of a longitudinal direction (MD direction) of each of the porous films and a width direction (TD direction) perpendicular to the longitudinal direction, and a mean value thereof was determined as the tensile strength. Measurement results are shown in Table 1. A case where the tensile strength is 5.5 N or more was determined as success.

(5) Observation of Film Structure

Each porous ePTFE film was observed with a scanning electron microscope at a magnification of 1000. As a result, it was confirmed that any of the films has a plurality of nodes and a plurality of fibrils formed between the nodes.

Moreover, an aspect ratio represented by length/diameter of each of the nodes was measured as follows. The magnification of the scanning electron microscope was adjusted so as to show at least one node having both ends observable in one field of view. Then, the length of the node and the width (diameter) of the node were measured, and the aspect ratio was determined. The aspect ratio was determined in each of any five fields of view, and the values were averaged to obtain the aspect ratio of each node. As a result of confirmation by the method, Nos. 1 to 4 in the following Table 1 each had an aspect ratio represented by length/diameter of each node of 25 or more, while Nos. 5 to 9 each had an aspect ratio represented by length/diameter of each node of lower than 25.

(6) Acoustic Property (Acoustic Evaluation Device)

Evaluation of an acoustic property was performed by using an acoustic evaluation device which simulates an acoustic device and which is schematically illustrated in FIGS. 2 and 3.

First, calibration of a speaker was performed by using the acoustic evaluation device illustrated in FIG. 2. The details are as follows. As illustrated in FIG. 2, a reference microphone 2A (manufactured by B&K, ¼-inch Pressure-Field Microphone 4938-A-011) was set in an anechoic box 1 (manufactured by B&K, Anechoic Test Box 4232). The distance between the microphone 2A and a speaker 3 incorporated in the anechoic box 1 was made 60 mm. Calibration of the speaker 3 was then performed such that a sound pressure level from the speaker 3 became 94 dB at all frequencies of 100 to 10000 Hz.

Subsequently, the reference microphone 2A was replaced with one having a microphone for measurement 2B (MEMS microphone: manufactured by Knowles, Zero-Height SiSonic™ Microphone SPU0410LR5H) and a part sample 4 corresponding to a waterproof sound-transmissive cover member which were attached to a part sample fixing jig 5 corresponding to a housing, and then actual measurement was performed. In this case, the distance between the microphone 2B and the speaker 3 was also made 60 mm. In this actual measurement, an MEMS microphone often used in a portable phone or the like was used as a microphone for measurement as described above. FIGS. 2 and 3 illustrate a conditioning amplifier 6, a power amplifier 7, and a computer 8.

FIG. 4 is an enlarged sectional view of the region R in FIG. 3. The microphone for measurement 2B and the part sample 4 are attached to the part sample fixing jig 5 which is made of plastic and which corresponds to a housing, as illustrated in FIG. 4. A channel part of the part sample fixing jig 5 represented by X in FIG. 4 has a diameter of 0.8 mm and a length of 2.0 mm, and a cavity part of the part sample fixing jig 5 represented by Y in FIG. 4 has diameter of 6.0 mm and a length of 1.0 mm. FIG. 4 illustrates a flexible substrate 9, and a double sided tape for fixing substrate 10.

The part sample 4 was prepared as follows. First, a hole having an inside diameter of 1.5 mm was formed at a double sided tape by punching. This double sided tape 4A and a porous film 4B serving as a waterproof sound-transmissive cover were laminated one on another, and then the vicinity of the hole was punched so as to have an outer diameter of 7 mm, and an annular part sample 4 illustrated in FIG. 5 was made. FIG. 5 is a top view of a part sample seen from the porous film side, and a sectional view cut along a diameter position.

(Evaluation Method)

Evaluation was performed as follows by using the above-described device. First, as a blank, a sound pressure level at frequencies of 100 to 10000 Hz was measured in a state where only the part sample 4 was not attached in FIG. 3. Subsequently, a sound pressure level at frequencies of 100 to 10000 Hz was measured in a state where the part sample 4 was attached as illustrated in FIG. 3. A frequency response curve was then obtained, which has a horizontal axis representing a frequency and a vertical axis representing a sound pressure level. Measurement in a state where the part sample 4 was attached was performed 5 times repeatedly. As an example of these measurement results, a frequency response curve of No. 4 in Table 1 and a frequency response curve of No. 5 in Table 1 are respectively illustrated in FIGS. 6 and 7. The following (a) to (e) were obtained from the obtained frequency response curves, and an insertion loss at a frequency of 1 kHz, that is, a value of [sound pressure level at a frequency of 1 kHz in the blank state: 94 dB]-[sound pressure level at a frequency of 1 kHz] was further obtained. Measurement results thereof are shown in Table 1.

(a) Sound pressure level at 1 kHz (b) Sound pressure level at 8 kHz (c) Sound pressure level difference in the range from 3 kHz to 8 kHz (3 k-8 kHz sound pressure level difference)

(d) Sound pressure level difference in the range from 3 kHz to 5 kHz (3 k-5 kHz sound pressure level difference)

(e) Sound pressure level difference in the range from 5 kHz to 8 kHz (5 k-8 kHz sound pressure level difference)

Then, a case where the 3 k-8 kHz sound pressure level difference satisfies 13.0 dB or less and an insertion loss at 1 kHz is less than 14.0 dB was determined as success. Moreover, the 3 k-5 kHz sound pressure level difference of 4.0 dB or less was evaluated as preferable, and the 5 k-8 kHz sound pressure level of 9.0 dB or less was evaluated as preferable. FIG. 8 shows a graph which was created by using data of Nos. 1 to 7 and which shows a relation between the air permeability and the insertion loss at 1 kHz.

TABLE 1

| | Properties of Films | | | | Acoustic Properties | | | | | |
|---|---|---|---|---|---|---|---|---|---|---|
| No. | Film Thickness (μm) | Water Pressure Resistance (kPa) | Air Permeability (cc/cm$^2$ · sec) | Tensile Strength (N) | Sound Pressure Level at 1 kHz[X2] (dB) | Insertion Loss at 1 kHz[X1] (dB) | Sound Pressure Level at 8 kHz (dB) | 3 k-8 kHz Sound Pressure Level Difference (dB) | 3 k-5 kHz Sound Pressure Level Difference (dB) | 5 k-8 kHz Sound Pressure Level Difference (dB) |
| 1 | 22.7 | 87.0 | 2.6 | 16.2 | 79.4 | 14.6 | 98.0 | 19.1 | 5.5 | 13.6 |
| 2 | 26.2 | 51.3 | 7.4 | 10.7 | 87.6 | 6.4 | 82.1 | 2.1 | 1.0 | 1.6 |
| 3 | 34.9 | 46.1 | 7.5 | 14.8 | 88.0 | 6.0 | 85.7 | 4.1 | 0.9 | 3.2 |
| 4 | 19.1 | 33.7 | 16.2 | 7.6 | 91.1 | 2.9 | 90.1 | 3.4 | 1.0 | 2.4 |
| 5 | 35.7 | 56.9 | 5.5 | 4.5 | 86.4 | 7.6 | 85.7 | 16.4 | 13.7 | 15.6 |
| 6 | 20.3 | 75.5 | 5.7 | 5.3 | 85.1 | 8.9 | 96.1 | 14.6 | 4.7 | 9.9 |
| 7 | 19.7 | 69.3 | 7.4 | 3.2 | 89.1 | 4.9 | 90.4 | 13.5 | 11.7 | 12.8 |
| 8 | 10.0 | — | 0.3 | — | 78.6 | 15.4 | 96.5 | 21.0 | 6.8 | 14.2 |
| 9 | 4.0 | 448.8 | 0.6 | 8.5 | 82.1 | 11.9 | 93.8 | 19.1 | 8.5 | 11.0 |

[X1] 94 dB (Sound Pressure Level at 1 kHz under a condition without film at the housing)-(Sound Pressure Level at 1 kHz[X2])

The following are clear from Table 1 and FIGS. 1 and 8. The porous films of Nos. 2 to 4 each satisfy the defined high water pressure resistance and also satisfy the defined air permeability, and each also have certain tensile strength or more. Particularly, it is clear from FIG. 8 that an insertion loss at 1 kHz can be suppressed sufficiently and reliably by sufficiently enhancing the air permeability. Moreover, it is clear from FIG. 1 that any of the porous films of Nos. 2 to 4 were able to achieve both of higher water pressure resistance and higher air permeability than a porous film of the related art. A waterproof sound-transmissive cover using this porous film exhibited an excellent acoustic property as shown in Table 1. Specifically, a sound pressure level loss was suppressed and a sound pressure level difference owing to frequencies in a frequency wideband was suppressed, and a stable acoustic property was exhibited.

On the other hand, No. 1 or No. 8 had small air permeability and a large insertion loss at 1 kHz. Moreover, a sound pressure level difference owing to frequencies in a wideband of frequencies from 3 kHz to 8 kHz was large. Nos. 5 to 7 had small tensile strength, and a sound pressure level difference owing to frequencies in a wideband of frequencies from 3 kHz to 8 kHz was large. Moreover, No. 9 is a film having a thin film thickness and considerably high water pressure resistance but small air permeability. In this film, particularly, a sound pressure level owing to frequencies in a wideband of frequencies from 3 kHz to 8 kHz was large.

Moreover, FIGS. 6 and 7 are each an overlapped view of results of measurement repeated five times under same conditions. In FIG. 7 showing a case of using a porous film out of the requirements of the present invention, peaks were large and maximum values of the peaks varied. On the other hand, it is clear from FIG. 6 showing a case of using a porous film satisfying the requirements of the present invention that peaks are suppressed to be sufficiently low or peaks hardly appear and, even when peaks slightly appear, maximum values of the peaks are constant at a frequency of approximately 8 kHz and hardly vary.

It is clear from the above-described results that it is effective to provide a porous film which has the above-described water pressure resistance and also both of air permeability and tensile strength exhibiting a certain value or more, in order to obtain a waterproof sound-transmissive cover having excellent waterproofness and an acoustic property higher than a product of the related art, particularly a sufficiently suppressed sound pressure level difference owing to frequencies over a wide frequency range. When this waterproof sound-transmissive cover is used in an acoustic device, excellent waterproofness is exhibited and the acoustic device can be protected, and also an acoustic device which stably exhibits an excellent acoustic property can be provided.

REFERENCE SIGN LIST

1 Anechoic box
2A Reference microphone
2B Microphone for measurement
3 Speaker
4 Part sample
4A Double sided tape
4B Porous film
5 Part sample fixing jig
6 Conditioning amplifier
7 Power amplifier
8 Computer
9 Flexible substrate
10 Double sided tape for fixing substrate
X Channel part of the part sample fixing jig
Y Cavity part of the part sample fixing jig

The invention claimed is:

1. A waterproof sound-transmissive cover comprising:

a porous film having:

(1) a water pressure resistance measured according to the JIS L1092 water penetration test method B (high pressure method) of 20 kPa or more, and air permeability measured according to the JIS L1096 method A (Frazier type method) of 3.0 cc/cm$^2$·sec or more, and (2) a tensile strength measured according to ASTM D412 standards of 5.5N or more;

wherein an acoustic device comprising the waterproof sound-transmissive cover provides a frequency response curve with a difference between a maximum sound pressure level and a minimum sound pressure level ("sound pressure level difference"), of 13.0 dB or less in the range of frequencies from 3 kHz to 8 kHz, and wherein an acoustic device comprising the waterproof sound-transmissive cover provides an insertion loss of less than 14.0 dB at 1 kHz.

2. The waterproof sound-transmissive cover according to claim 1, wherein the porous film comprises a porous polytetrafluoroethylene film, wherein the porous film comprises:

a plurality of nodes and a plurality of fibrils formed between the plurality of nodes;

wherein each of the nodes has an aspect ratio of 25 or more, wherein the aspect ratio is defined by a ratio of the length of each node to a diameter of each node.

3. The waterproof sound-transmissive cover according to claim 1, wherein the waterproof sound-transmissive cover has a thickness in the range of 10 to 300 micrometers.

4. The waterproof sound-transmissive cover according claim 1, wherein said water pressure resistance is 55 kPa or less.

5. The waterproof sound-transmissive cover according to claim 1, wherein the frequency response curve provides a sound pressure level at a frequency of 8 kHz that is smaller than a sound pressure level at a frequency of 1 kHz.

6. The waterproof sound-transmissive cover according to claim 1, wherein the frequency response curve provides:

a sound pressure difference in the range of frequencies from 3 kHz to 5 kHz of 4.0 dB or less, and a sound pressure difference in the range of frequencies from 5 kHz to 8 kHz of 9.0 dB or less.

7. The waterproof sound-transmissive cover according to claim 1, wherein the porous film is a single layer of the porous polytetrafluoroethylene film.

8. The waterproof sound-transmissive cover according to claim 1, wherein the water pressure resistance of the porous film, measured according to the JIS L1092 water penetration test method B (high pressure method), is from 20 kPa to 90 kPa.

9. The waterproof sound-transmissive cover according to claim 1, wherein the air permeability of the porous film, measured according to the JIS L1096 method A (Frazier type method) is from 3.0 cc/cm$^2$·sec to 10 cc/cm$^2$·sec.

10. The waterproof sound-transmissive cover according to claim 1, wherein the sound pressure level difference is from 3.0 dB to 13.0 dB in the range of frequencies from 3 kHz to 8 kHz.

11. The waterproof sound-transmissive cover according to claim 1, wherein an acoustic device comprising the waterproof sound-transmissive cover provides an insertion loss of 5.0 dB to 14.0 dB at 1 kHz.

12. A waterproof sound-transmissive cover member comprising:

(A) a waterproof sound-transmissive cover comprising a porous film having:

(1) a water pressure resistance measured according to the JIS L1092 water penetration test method B (high pressure method) of 20 kPa or more, and air permeability measured according to the JIS L1096 method A (Frazier type method) of 3.0 cc/cm$^2$ sec or more, and (2) a tensile strength measured according to ASTM D412 standards of 5.5N or more; and (B) a support layer formed on at least one side of the waterproof sound-transmissive cover wherein an acoustic device comprising the waterproof sound-transmissive cover member provides a frequency response curve with a difference between a maximum sound pressure level and a minimum sound pressure level ("sound pressure level difference"), of 13.0 dB or less in the range of frequencies from 3 kHz to 8 kHz, and wherein an acoustic device comprising the waterproof sound-transmissive cover member provides an insertion loss of less than 14.0 dB at 1 kHz.

13. An acoustic device, comprising:

(A) a housing having an opening configured to pass an acoustic wave therethrough;

(B) an acoustoelectric converter disposed inside of the housing; and (C) a waterproof sound-transmissive cover member, comprising:

(1) a waterproof sound-transmissive cover comprising a porous film having:

(I) water pressure resistance measured according to the JIS L1092 water penetration test method B (high pressure method) of 20 kPa or more, and air permeability measured according to the JIS L1096 method A (Frazier type method) of 3.0 cc/cm$^2$·sec or more, and (II) a tensile strength measured according to ASTM D412 standards of 5.5N or more; and (2) a support layer formed on at least one side of the waterproof sound-transmissive cover wherein the waterproof sound-transmissive cover member covers the opening of the housing, wherein the acoustic device provides a frequency response curve with a difference between a maximum sound pressure level and a minimum sound pressure level ("sound pressure level difference"), of 13.0 dB or less in the range of frequencies from 3 kHz to 8 kHz, and wherein the acoustic device provides an insertion loss of less than 14.0 dB at 1 kHz.

14. The acoustic device of claim 13, wherein the device is configured to send an acoustic wave.

15. The acoustic device of claim 13, wherein the device is configured to receive an acoustic wave.

16. The acoustic device of claim 13, wherein the device is configured to send and receive an acoustic wave.

* * * * *